US008276317B2

(12) United States Patent
Williams et al.

(10) Patent No.: US 8,276,317 B2
(45) Date of Patent: Oct. 2, 2012

(54) AUTO LOCKING, MANUAL UNLOCKING DOOR STAY

(75) Inventors: Alun Williams, Southhampton (GB); William Eyers, Woking (GB); Christopher R. Norman, Winchester (GB); Martin Phillips, Guilford (GB)

(73) Assignee: General Electric Company, Schenectady, NY (US)

( * ) Notice: Subject to any disclaimer, the term of this patent is extended or adjusted under 35 U.S.C. 154(b) by 228 days.

(21) Appl. No.: 12/875,241

(22) Filed: Sep. 3, 2010

(65) Prior Publication Data

US 2012/0055095 A1 Mar. 8, 2012

(51) Int. Cl.
*E05B 65/06* (2006.01)

(52) U.S. Cl. ..... 49/394; 292/262; 292/DIG. 15; 292/277; 292/266; 292/289

(58) Field of Classification Search ..... 49/394; 292/262, 271–273, 277, 265, 266, 289, 292, 292/295, 297, 342, 338, 175, 145, 146, 150, 292/DIG. 15
See application file for complete search history.

(56) References Cited

U.S. PATENT DOCUMENTS

| | | | | |
|---|---|---|---|---|
| 241,338 | A * | 5/1881 | Esooubes | 292/265 |
| 1,673,611 | A * | 6/1928 | Williams et al. | 292/262 |
| 1,910,883 | A * | 5/1933 | Caroselli | 16/82 |
| 3,174,179 | A * | 3/1965 | Benson | 16/375 |
| 4,976,476 | A | 12/1990 | Cross et al. | |
| 5,044,182 | A | 9/1991 | Totten | |
| 5,473,841 | A * | 12/1995 | Grillo | 49/394 |
| 6,149,212 | A * | 11/2000 | Kuntz et al. | 292/288 |
| 6,292,981 | B1 * | 9/2001 | Ford et al. | 16/357 |
| 6,641,183 | B2 | 11/2003 | Brown | |
| 7,522,042 | B2 * | 4/2009 | Milo | 340/545.1 |
| 2006/0242908 | A1 * | 11/2006 | McKinney | 49/280 |

FOREIGN PATENT DOCUMENTS

GB 2137686 A * 10/1984

* cited by examiner

*Primary Examiner* — Jerry Redman
(74) *Attorney, Agent, or Firm* — Nixon & Vanderhye, P.C.

(57) ABSTRACT

A door stay device for automatically locking a door in an open position includes a first component adapted to be attached to a stationary support, the first component including a plate having a curved cam edge with a radius matched to a swinging movement of the door between closed and open positions. The plate has a slot open at the cam edge at a location corresponding to the open position of the door. A second component is adapted to be secured at a lower or upper edge of a door, the second component having a locking member arranged to move into the slot when the locking member is aligned with the slot and the door is in the open position.

20 Claims, 2 Drawing Sheets

AUTO LOCKING, MANUAL UNLOCKING DOOR STAY

BACKGROUND OF THE INVENTION

This invention relates to doors which are subject to operation in high winds and, more particularly, to a door stay that automatically locks the door in an open position when the door swings through a predetermined angle.

Specifications provided by customers often state that doors must remain open at a certain angle under all conditions. Conventional door stays, some of which are described below, are not suitable and could thus result in non-compliance with the customer specifications.

Current door stay designs that lock automatically after a predetermined movement of the door in the opening direction often rely on further door movement in the same direction to unlock the stay, allowing the door to close, for example, under a conventional biasing force in the closing direction. This is unsuitable in high wind areas where the door may unlatch inadvertently due to further movement of the door caused by the wind, and thus cause the door to close.

Conventional scissor-type automatic latching devices are also unsuitable for operation under high wind conditions where external forces are present.

There remains a need therefore, for a door stay that enables the door to automatically lock in the open position upon movement of the door through a predetermined angle, e.g. 80-130 degrees or more, but that will not unlatch due to unintended further movement of the door in either direction.

BRIEF SUMMARY OF THE INVENTION

In an exemplary but non-limiting embodiment, the present invention provides a door stay device for automatically locking a door in an open position comprising a first component adapted to be attached to a stationary support, the first component including a plate having a curved cam edge with a radius substantially matched to a swinging movement of the door between closed and open positions, the plate having a first slot open at the curved cam edge at a location corresponding to the open position of the door; a second component adapted to be secured at a lower or upper edge of the door, the second component having a lock bar arranged to slide along the cam edge and move into the first slot when the lock bar is aligned with the slot.

In another aspect the invention provides a door stay device for automatically locking a door in an open position comprising a first component adapted to be attached to a stationary support, the first component including a plate having a curved cam edge with a radius substantially matched to a swinging movement of the door between closed and open positions, the plate having a first slot open at the curved cam edge at a location corresponding to the open position of the door; a second component adapted to be secured at a lower or upper edge of the door, the second component comprising a member in which a lock bar is spring-biased for sliding movement into the slot when the lock bar is aligned with the first slot and the door is in the open position, and wherein the lock bar is provided with a handle permitting a user to manually withdraw the lock bar from the first slot in order to enable movement of the door from the open to the closed position.

In still another aspect, the invention provides a door panel and door stay assembly comprising a door panel attached to a stationary support for swinging movement between closed and open positions; a first door stay component attached to the stationary support, the first door stay component including a cam plate having a curved cam edge with a radius substantially matched to the swinging movement of the door panel between the closed and open positions, the cam plate having a first slot open at the curved cam edge at a location corresponding to the open position of the door panel; a second door stay component secured at a lower or upper edge of the door panel, the second door stay component having a lock bar arranged to move automatically into the first slot when the lock bar is aligned with the first slot and the door panel is in the open position.

The invention will now be described in connection with the drawings identified below.

DETAILED DESCRIPTION OF THE INVENTION

Figure 1:
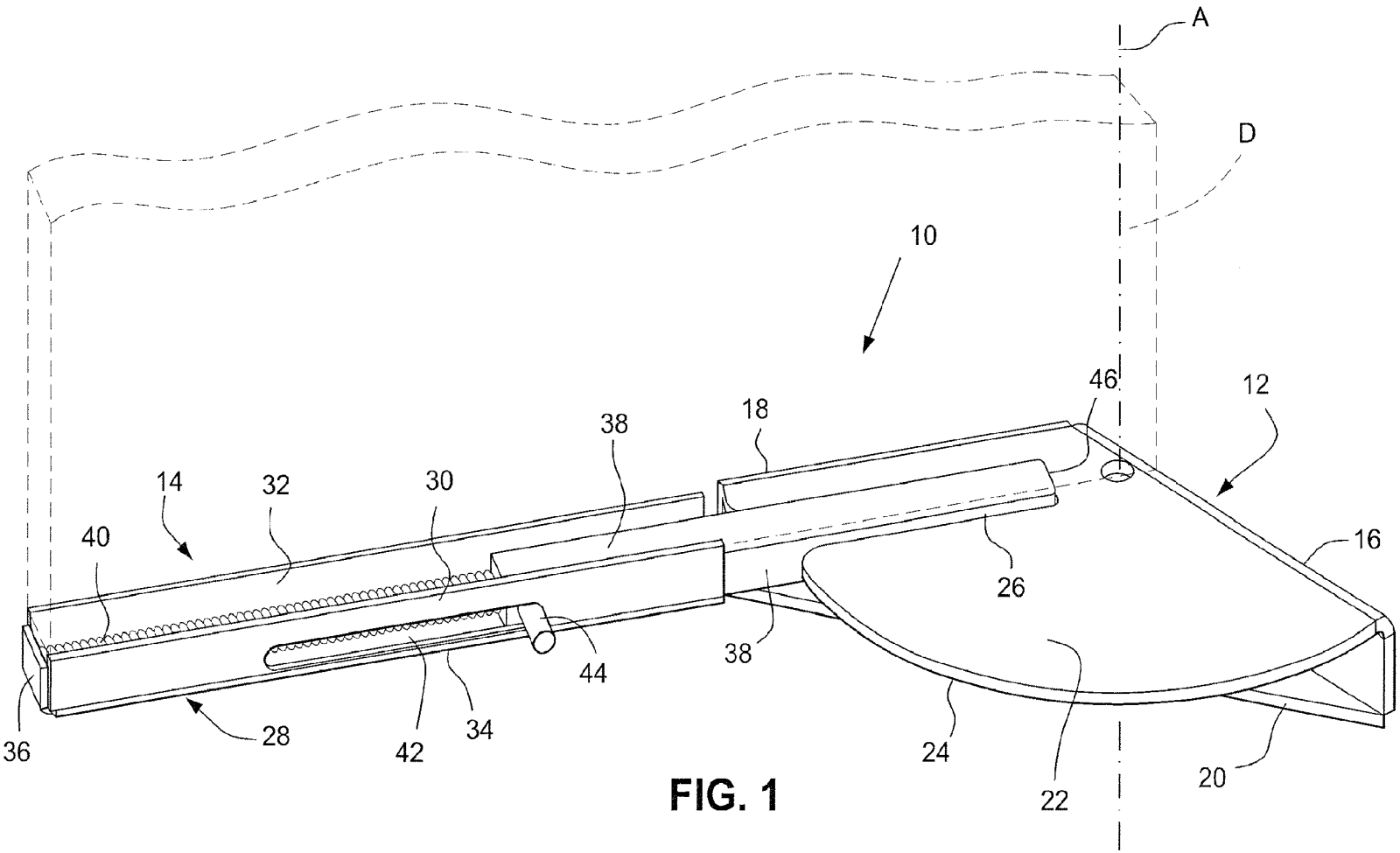
FIG. 1 is a perspective view of a door stay comprising stationary and moveable components associated with a lower door edge in accordance with an exemplary but non-limiting embodiment of the invention.
Figure 2:
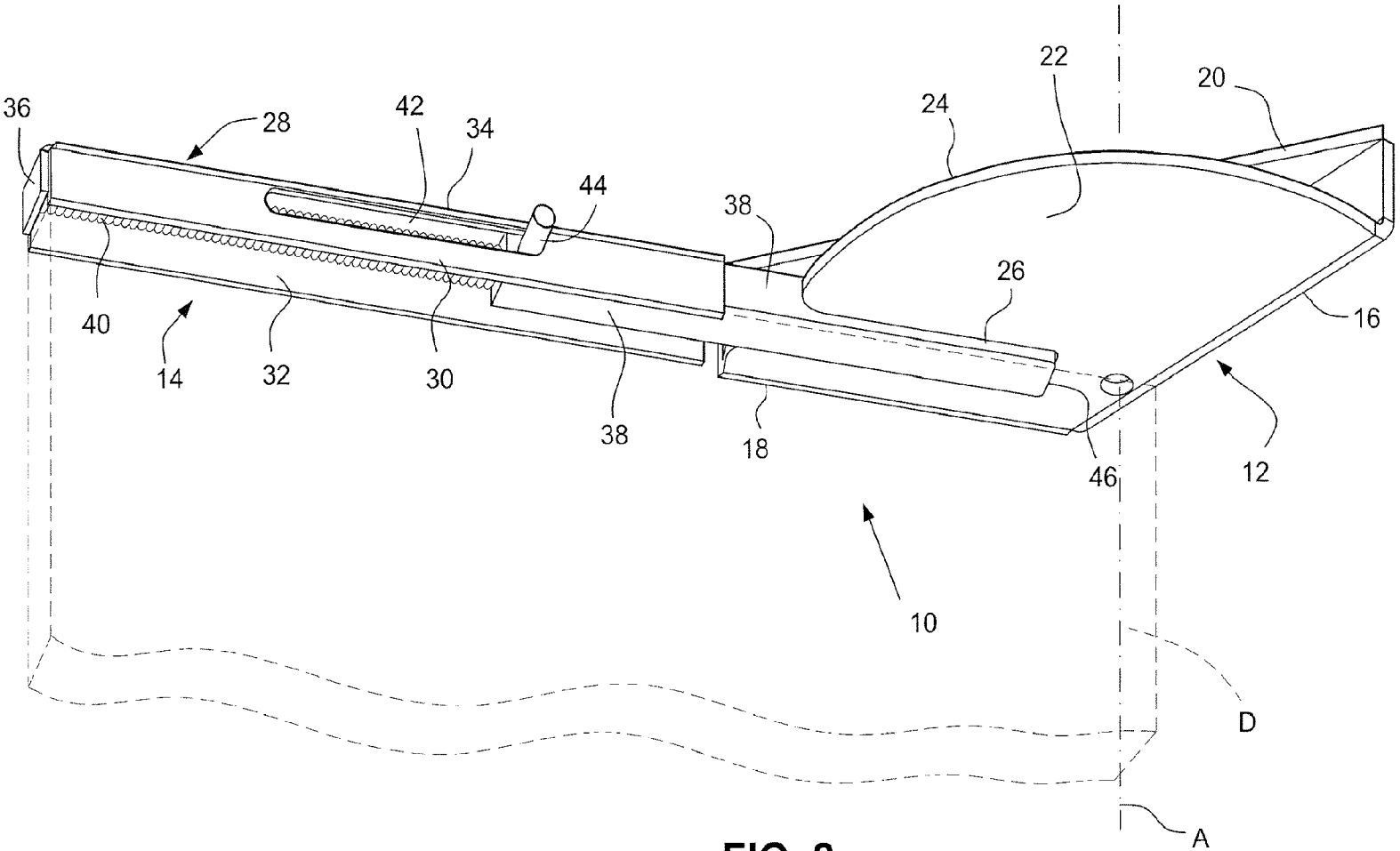
FIG. 2 is a perspective view similar to FIG. 1 but where the components are associated with an upper door edge.

With reference to FIG. 1, the door stay assembly 10 includes a stationary component 12 to be mounted to a door frame, wall or other stationary support, and a moveable component 14 adapted to be mounted on or at the bottom edge of the door (shown in phantom at D) mounted for pivoting movement about the pivot axis A. It will be appreciated, however, that both components as described herein may also be arranged at the top of the door if so desired as shown in FIG. 2.

The stationary component 12 includes a rigid angle bracket formed by flat metal rods or flanges 16, 18 arranged, in the exemplary embodiment, substantially perpendicular to each other, and that may be secured by, for example, welding, where they intersect each other. The angle bracket is reinforced by a substantially triangular-shaped gusset plate 20 which may be welded along the lower interior edges of the rods 16, 18.

A cam plate 22 is secured, for example, by welding, along the upper interior edges of the rods 16, 18, substantially parallel to the gusset plate 20. It should be understood that rods 16, 18 could also be formed as integral flanges of the cam plate 22. The cam plate 22 is formed with a curved cam edge 24 extending from a remote end of the angle rod or flange 16 to a corresponding remote end of the angle rod or flange 18, and interrupted by an elongated, substantially rectangular slot 26 extending parallel to the angle rod or flange 18 and in relatively close proximity thereto. Thus, the cam edge in the illustrated embodiment extends along an arc of substantially 90 degrees, and is substantially matched to the swinging movement of the door D. It will be appreciated that the cam plate 22 and rods or flanges 16, 18 could also be formed to accommodate wider swing range for the door, e.g., between about 80-130 degrees or more.

The moveable component 14 includes a U-shaped channel component 28 formed by parallel side plates 30, 32 connected by a flat-base component 34, thus forming an upwardly-open channel closed at its remote end by an end wall 36. The channel component 28 could also be a one-piece extruded, welded, or otherwise formed U-shaped or closed member with an end wall 36. A lock bar 38 is sized to slide within the channel component 28 with a coil spring or other suitable biasing means 40 exerting a force on the lock bar 38 in a direction axially away from the channel component, i.e., toward the cam plate 22.

A slot 42 formed in the side plate 30 of the U-shaped channel component 28 allows a transverse pin 44 fixed at the back end of the lock bar 38 to slide within the slot 42. Thus, the transverse pin 44, in effect, provides a handle by which a user may pull the lock bar 38 rearwardly (to the left in FIG. 1) against the bias of the spring 40 as described further below. A slanted end wall of the lock bar 38 is adapted to slide along the cam edge 24 of the cam plate 22 as also described further below.

In use, as the door D to which the channel component 28 is secured moves from a closed to an opened position (in a clockwise direction as viewed in the drawing figure) the slanted end wall 46 of the lock bar 38 will move with the door, sliding along the fixed cam plate edge 24, with a substantial portion of the lock bar 28 located within the channel component 28, compressing the spring 40 to the left as viewed in the drawing. When the door D has swung approximately 90 degrees in the illustrated embodiment, the lock bar 38 will be driven into the slot 26 by the spring 40, thus locking the door in the open position.

It will be appreciated that no further unintended movement of the door in either the opening or closing direction is possible, thereby eliminating any possible unintended unlocking of the door stay under, for example, high wind conditions.

When it is desired to close the door, the transverse peg or pin 44 is grasped and pulled rearward (to the left), drawing the lock bar 38 out of slot 26. At this point, the door may return, automatically by a conventional spring bias, or may be swung to a closed position, with the end wall 46 again sliding along (and biased against) the curved cam edge 24 of the cam plate 22.

It will be understood that the configuration of the stationary component 12, and particularly the arrangement of the rods 16, 18 and the gusset plate 20 may vary with different applications. The configuration of the channel component 28, lock bar 38 and spring 40 may also vary, and the location of the slot 42 and pin 44 could be relocated to the other side of the channel component 28 for convenience. The choice of materials and specific dimensions of the components are also application dependent and well within the skill of the art.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A door stay device for automatically locking a door in an open position comprising:

a first component adapted to be attached to a stationary support, said first component including a stationary plate having a curved cam edge with a radius substantially matched to a swinging movement of the door between closed and open positions, said stationary plate having a first elongated slot open at said curved cam edge at a location corresponding to the open position of the door;

a second component adapted to be secured at a lower or upper edge of the door, said second component supporting an elongated lock bar arranged to slide along said curved cam edge and move linearly into said first elongated slot when said lock bar is aligned with said slot.

2. The door stay device of claim 1 wherein said first component further comprises an angle bracket, one of which is arranged substantially parallel to the door when the door is in the closed position, and the other of which is substantially parallel to the door when the door is in the open position.

3. The door stay device of claim 2 wherein said stationary plate is supported on said angle bracket, and wherein said slot in said stationary plate lies adjacent said other of said pair of flanges.

4. The door stay device of claim 2 wherein said stationary first component further comprises a reinforcing gusset plate attached to an underside of said angle bracket.

5. The door stay device of claim 1 wherein said curved cam edge extends along an arc of between about 80-130 degrees.

6. The door stay device of claim 1 wherein said second component comprises an elongated channel in which said elongated lock bar is slidably mounted, said lock bar biased for movement toward said plate.

7. The door stay device of claim 6 wherein said lock bar is biased by a spring housed in said elongated channel.

8. The door stay device of claim 1 wherein said lock bar is substantially rectangular in shape with parallel side edges, and wherein said forward edge of said lock bar is not perpendicular to either of said side edges.

9. The door stay device of claim 1 wherein said elongated channel includes a side wall formed with a second slot and said lock bar is provided with a handle moveable within said second slot, permitting a user to manually withdraw said lock bar from said slot in order to enable movement of the door from the open to the closed position.

10. A door stay device for automatically locking a door in an open position comprising:

a first component adapted to be attached to a stationary support, said first component including a plate having a curved cam edge with a radius substantially matched to a swinging movement of the door between closed and open positions, said plate having a first slot open at said curved cam edge at a location corresponding to the open position of the door;

a second component adapted to be secured at a lower or upper edge of the door, said second component comprising an elongated channel in which a lock bar is spring-biased for sliding linear movement into said first slot when said lock bar is aligned with said first slot and the door is in the open position, and wherein said lock bar is provided with a handle permitting a user to manually withdraw said lock bar from said first slot in order to enable movement of the door from the open to the closed position.

11. The door stay device of claim 10 wherein a forward edge of said locking member is adapted to slide along said curved cam edge as said door moves from the closed to the open position.

12. The door stay device of claim 10 wherein said handle is moveable within a second slot provided in said channel.

13. A door panel and door stay assembly comprising:

a door panel attached to a stationary support for swinging movement between closed and open positions;

a first door stay component attached to the stationary support, said first door stay component including a cam plate having a curved cam edge with a radius substantially matched to the swinging movement of the door panel between the closed and open positions, said cam plate having a first slot open at said curved cam edge at a location corresponding to the open position of the door panel;

a second door stay component secured at a lower or upper edge of the door panel, said second door stay component supporting a lock bar arranged to move automatically and linearly into said slot when said lock bar is aligned with said first slot and said door panel is in said open position.

14. The door panel and door stay assembly of claim 13 wherein said curved cam edge extends along an arc of between about 80-130 degrees.

15. The door panel and door stay assembly of claim 13 wherein said second door stay component comprises a member in which said lock bar is slidably mounted, said lock bar biased for movement into said first slot.

16. The door panel and door stay assembly of claim 15 wherein said lock bar is biased by a spring housed in said member.

17. The door panel and door stay assembly of claim 15 wherein said lock bar is provided with a handle permitting a user to manually withdraw said lock bar from said first slot in order to enable movement of said door panel from the open to the closed position.

18. The door panel and door stay assembly of claim 17 wherein said handle comprises a pin extending out of said lock bar and projecting through a second slot in a side of said member.

19. The door panel and door stay assembly of claim 13 wherein a forward edge of said lock bar is adapted to slide along said curved cam edge as said door moves between the open and closed positions.

20. The door panel and door stay assembly of claim 13 wherein said cam plate further comprises a pair of flanges, one of which is arranged substantially parallel to the door when the door is in the closed position, and the other of which is substantially parallel to the door when the door is in the open position.

* * * * *

UNITED STATES PATENT AND TRADEMARK OFFICE

CERTIFICATE OF CORRECTION

PATENT NO. : 8,276,317 B2
APPLICATION NO. : 12/875241
DATED : October 2, 2012
INVENTOR(S) : Alun Williams et al.

It is certified that error appears in the above-identified patent and that said Letters Patent is hereby corrected as shown below:

In the Specification:

At column 3, line 10, insert --46-- after “slanted end wall” and before “of the lock bar 38”

In the Claims:

In Claim 4 at column 4, lines 10-11, delete “wherein said stationary first component” and insert --wherein said first component--

Signed and Sealed this
Eighteenth Day of December, 2012

David J. Kappos
*Director of the United States Patent and Trademark Office*